United States Patent [19]

Gregory

[11] 4,434,842

[45] Mar. 6, 1984

[54] PLATE FIN HEAT EXCHANGER

[75] Inventor: Edward J. Gregory, Wolverhampton, England

[73] Assignee: IMI Marston Limited, Wolverhampton, England

[21] Appl. No.: 324,568

[22] Filed: Nov. 24, 1981

[30] Foreign Application Priority Data

Dec. 2, 1980 [GB] United Kingdom ..... 8038639

[51] Int. Cl.[3] ..... F28F 3/06; F28F 13/00

[52] U.S. Cl. ..... 165/133; 165/166

[58] Field of Search ..... 62/527; 165/133, 166

[56] References Cited

U.S. PATENT DOCUMENTS

| | | | |
|---|---|---|---|
| 3,299,949 | 1/1967 | Beurtheret | 165/133 X |
| 3,684,007 | 8/1972 | Ragi | 165/133 |
| 3,825,064 | 7/1974 | Inoue | 165/133 X |
| 3,971,435 | 7/1976 | Peck | 165/133 X |
| 4,182,412 | 1/1980 | Shum | 165/133 |
| 4,246,057 | 1/1981 | Janowski et al. | 165/133 X |
| 4,284,133 | 8/1981 | Gianni et al. | 165/133 |

FOREIGN PATENT DOCUMENTS

| | | | |
|---|---|---|---|
| 53452 | 6/1982 | European Pat. Off. | 165/133 |
| 52-9160 | 1/1977 | Japan | 165/133 |
| 52-11465 | 1/1977 | Japan | 165/133 |

*Primary Examiner*—Sheldon J. Richter

*Attorney, Agent, or Firm*—Cushman, Darby & Cushman

[57] ABSTRACT

A heat exchanger in which liquids are boiled, the heat exchanger being provided with fins in the boiling region, the fins comprising a corrugated layer formed of two sheets, each sheet being apertured, the sheets being in close proximity one to the other such that nucleation of bubbles occurs between the sheets and the bubbles are released by the apertures in the sheets.

16 Claims, 7 Drawing Figures

FIG.1
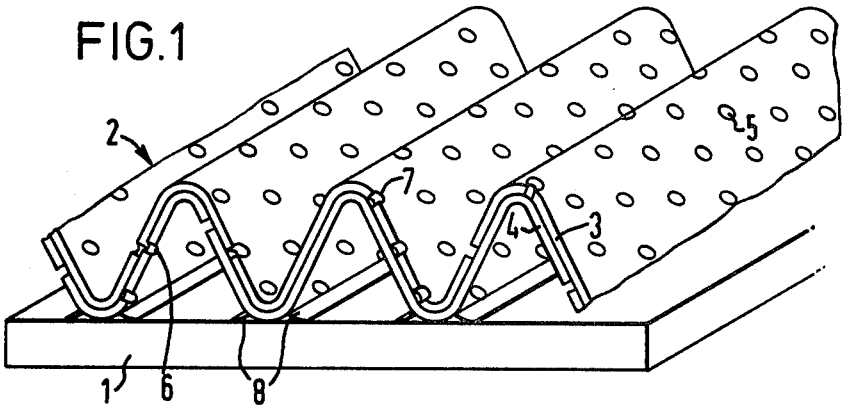
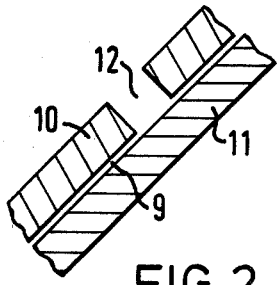
FIG.2
FIG. 3
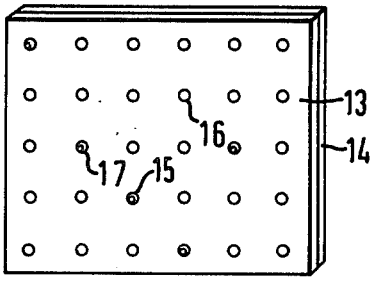
FIG.4
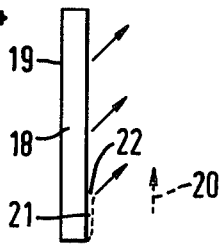
FIG. 5
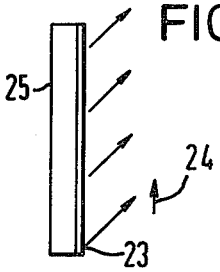

PLATE FIN HEAT EXCHANGER

BACKGROUND OF THE INVENTION

This invention relates to heat exchangers having nucleation and boiling surfaces for boiling liquids.

It is known that the nucleation and boiling characteristics of a surface can be modified by altering the physical texture of the surface. The process of boiling requires the nucleation of minute bubbles in the liquid which then grow to a size sufficient for them to be released from the liquid. It is preferred that there is a large number of nucleation sites in a liquid so that many reasonably small bubbles can form, rather than a few large ones. When liquefied gases are evaporated in heat exchangers it is desired that the gases nucleate and form bubbles as easily as possible. It has been proposed, therefore, to roughen the surface of the inside of a heat exchanger to enhance the nucleation and boiling characteristics of the heat exchanger surfaces. Such roughening is somewhat complex to arrange and hence expensive. There is also a problem in that the formation of a minute bubble at one nucleation site on a surface results in heat being drawn to that site from the surrounding area to evaporate liquid into the forming bubble. This means that the entire surface area of the surface is never in complete production of small bubbles, as sites are continuously formed and influence their surrounding areas to prevent further nucleation in a very localised region. To date the methods of improving the nucleation and boiling characteristics of surfaces have in the main related to methods and processes for texturising the surfaces.

Additionally there have been proposals to provide nucleate boiling surfaces on the heated surface of a heat exchanger by preparing closely spaced grooves in the metal wall and then deforming the outer ridges over the ends of the grooves so that cavities are provided with narrow exits from the re-entrant cavities. Essentially this method is used on tubular heat exchangers because of the relative ease with which the grooves may be formed in circular tube walls. Such a heat exchanger is described in U.S. Pat. No. 3,454,081.

In UK Patent Specification No. 1,328,919 there is a proposal to provide stamped metal foil promoters which are attached to a liquid boiler wall, the metal foil having a three-dimensional array of pyramid shaped elements which are pierced on their top and which are bonded to a base surface. It has also been proposed to use loosely fitting wire or non-metallic cord wrapped in the space between the fins of an integral finned tube, see for example U.S. Pat. No. 3,521,708.

SUMMARY OF THE INVENTION

By the present invention there is provided a heat exchanger for boiling a liquid, the heat exchanger having a fluid impervious surface adapted and arranged to be heated in use on the first side and to have a liquid to be vaporised on the second side, the second side having at least one fin extending, in use, into the liquid to be vaporised wherein the improvement comprises the fin being of at least two layers, one at least of the outer layers having a plurality of holes therein.

The fin may comprise two layers, each layer having a plurality of holes therein, some at least of the holes being non-coincident between the two sheets. The fins may be of metal and the layers may touch over part of their area.

Preferably the heat exchanger is a plate-fin type heat exchanger and the fin being between one pair at least of the plates and being in the form of a corrugated fin. Preferably in at least that part of the heat exchanger adapted to boil liquids all of the fins are in the improved form.

The fins may be formed of aluminium and may be bonded to the fluid impervious surface. The gap between the layers of the fin may be in the region 2 to 50 microns, preferably 2 to 10 microns, and preferably 5 microns.

The holes may have a diameter in the range 100 to 3,000 microns, preferably 500 to 2,000 microns. The holes may be disposed at an overall density of 5 to 10 per $cm^2$, preferably at a density of 6 per $cm^2$.

The thickness of each layer of the fin(s) may be in the range 0.1 to 0.3 mm, preferably 0.1 to 0.2 mm and further preferably 0.15 mm.

The fins may be formed by superimposing two or more layers of apertured sheets one above the other and the superimposed sheets may be corrugated together. The heat exchanger is preferably a plate fin heat exchanger having a plurality of plates separated by a plurality of layers of corrugated fins, the corrugated fins in the region of the heat exchanger adapted and arranged to boil liquids being of the improved type, the assembly being brazed together to form the heat exchanger.

BRIEF DESCRIPTION OF THE DRAWINGS

By way of example embodiments of the present invention will now be described with reference to the accompanying drawings, of which FIG. 1 is a perspective view of a corrugated fin heat exchanger surface in accordance with the present invention;

FIG. 2 is an enlarged view of two layers in accordance with the present invention;

FIG. 3 is a perspective side elevational view of two layers in accordance with the present invention;

FIG. 4 is a schematic view of a prior art surface;

FIG. 5 is a schematic view of a surface in accordance with the present invention.

DESCRIPTION OF THE PREFERRED EMBODIMENTS

Figure 6:
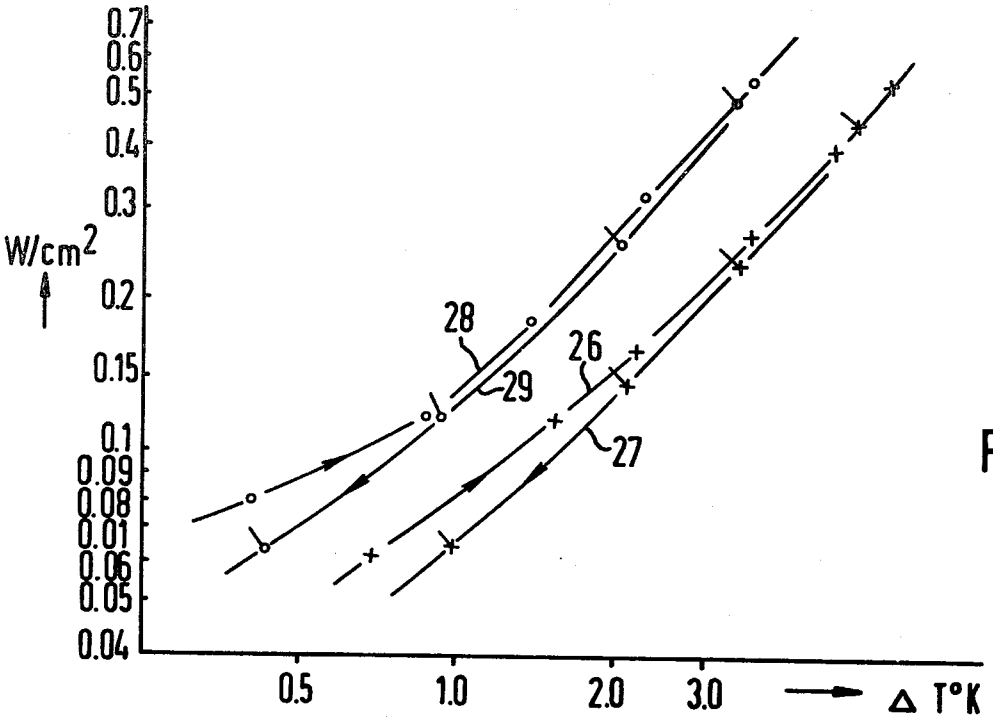
FIGS. 6 and 7 are graphs of heat flux against temperature difference.

Referring to FIG. 1 this shows a heat exchanger plate 1 having brazed to it a corrugated fin indicated generally by 2. The corrugated fin is formed of two aluminium sheet layers 3 and 4. Each layer comprises a sheet of aluminium of approximately 0.15 mm thick and having a plurality of apertures disposed thereover. Each aperture such as 5 has a diameter of 1,000 microns and the space between each aperture and its neighbour is approximately 5 mm. It can be seen that the apertures coincide in some locations, such as 6, whereas in other places the apertures do not coincide, such as at 7. The fin 2 is formed by superimposing one apertured layer of aluminium over another. Preferably the apertures are so arranged that they do not coincide over the entire surface of the fin. The two layers, without any bonding, are then passed through a conventional corrugation machine to form a corrugated fin having two individual layers. It has been found that the corrugated fin does not tend to come apart as the act of stretching and deforming the two layers to form the fin provides some mechanical interlink between the layers to prevent them springing apart.

The corrugated fin is then brazed to the heat exchanger plate 1 in a conventional manner such as by salt bath brazing or vacuum brazing. Brazed fillets 8 attach the fins firmly to the plate 1. Where there is an aperture in the plate 4 which coincides with the fillet, small quantities of brazing metal pass between the corrugations locally to firmly anchor the corrugated fin to the plate 1. Although there will be regions where the corrugated layers are in firm contact with one another there will also be regions where there will be a small gap between the fins. Shown in an enlarged view in FIG. 2 the gap 9 between fins 10 and 11 can be seen to be in direct communication with aperture 12.

It will be appreciated that a preferred plate fin type heat exchanger would comprise a series of plates which define alternate passageways for the passage of fluids. Through one set of alternate passageways a relatively hot fluid would be passed to heat and boil a relatively colder liquid passing through the alternate set of passageways. The two layer corrugated fin would be provided in the passageways in which a liquid is to be evaporated. The fins, if they are present, in the relatively higher temperature passageways may well be of a conventional single layer material or if desired for reasons of simplicity could be of a double layer design. It will be appreciated that a complex heat exchanger in accordance with the present invention effectively provides a solid core manufactured by the method set out above having a series of tanks attached to the outside of the core by which fluids are passed through the core and are received from the core having passed through it.

It is believed, although it will be appreciated that if the theory is incorrect it will not affect the validity of any patent granted for any invention, that bubbles nucleate within the gap 9. The gap has regions where its thickness is about 5 microns, which is believed to coincide with the ideal diameter of a hole for the nucleation of a bubble. Once nucleation has occurred it can spread readily throughout the region of the gap over the entire surface of the heat exchanger. The bubbles can grow in the apertures 12 and are released by them. From the view of the heat exchanger surface illustrated in FIG. 3 it can be seen that there will be regions where both holes in the layers 13 and 14 entirely coincide, such as at 15. In certain cases the holes, such as hole 16, will be located opposite a blank wall of layer 14. In other holes, such as hole 17, there will be a small overlap between the holes in sheet 13 and in 14.

Observation of the nucleation and boiling characteristics of the surface of the invention, when compared to the prior art, have resulted in the discovery that there is an improved boiling characteristic of the surface when compared to the prior art. Illustrated in FIG. 4 there is a heat exchanger surface 18 which is heated from side 19. Liquid passes vertically up along the heat exchanger surface in the direction of dotted arrow 20. It has been found that although heating takes place in region 21, there is a certain distance up the surface before bubbles start to be released in the region of 22. By comparison with the invention, however, as is shown in FIG. 5, the bubbles are released right at the bottom in the region of 23. Again liquid flows vertically in the direction of arrow 24 and heating is provided from surface 25.

Figure 7:
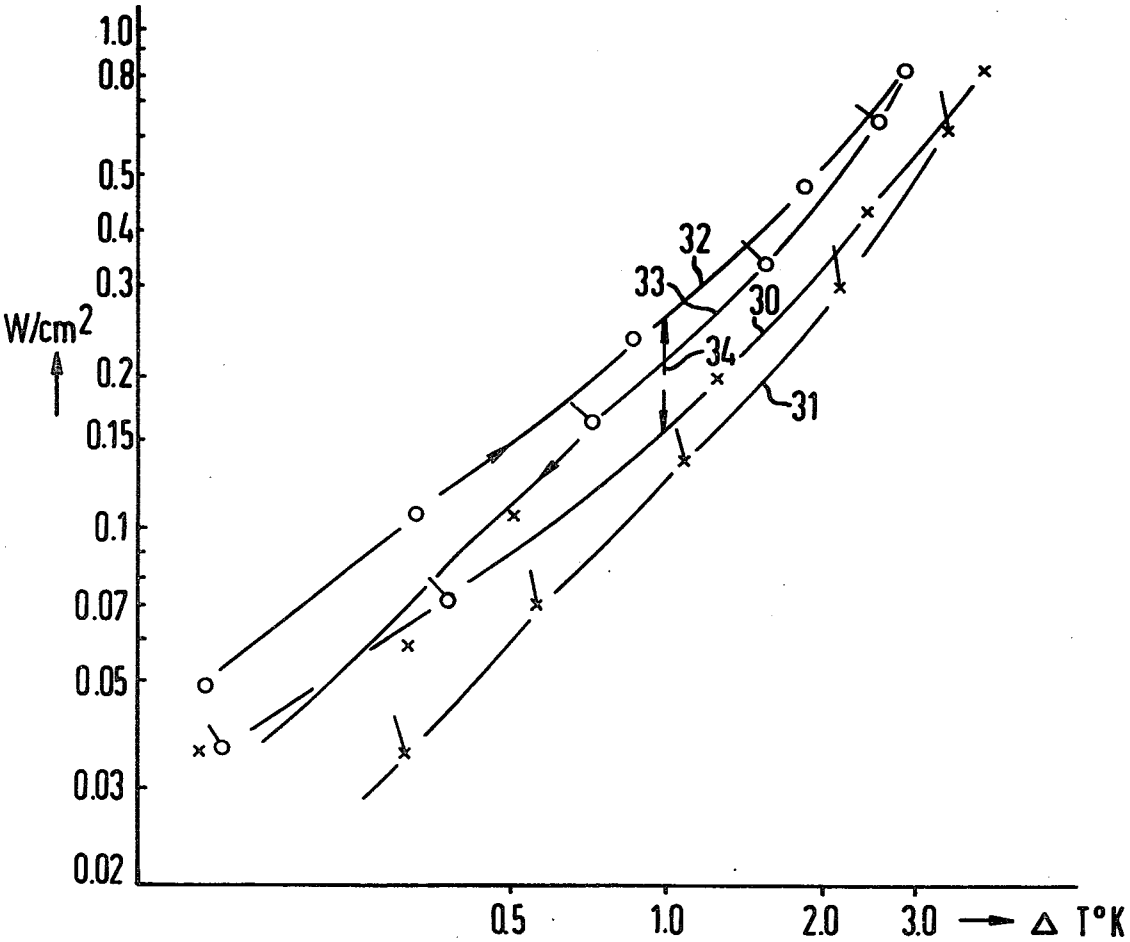

The improvements in the heat exchanger surface can be more clearly understood with reference to FIGS. 6 and 7. FIGS. 6 and 7 illustrate in graphical form heat flux versus temperature difference. Experimentally a heat exchanger surface was immersed in liquid nitrogen and one side of the surface has its temperature raised. The amount of heat transferring through the surface was then measured and plotted against the increase in temperature. In FIG. 6 the form of construction basically comprised a plate of aluminium having brazed thereto a corrugated fin of aluminium. The corrugations were disposed vertically and liquid nitrogen was passed over the corrugated surface. The lines 26, 27 relate to prior art devices incorporating a fin formed of a single sheet of metal. The line 26 relates to the heat transferred across the surface while the temperature was being increased and the line 27 refers to the heat transferred across the surface where the temperature was being decreased.

An identical set-up was then used, except that the single fin was replaced by a fin having two layers and formed in accordance with the invention. Again two lines were generated, namely 28 and 29, where the temperature was being increased and decreased. It will be appreciated that the graph illustrates both the heat flux and the temperature difference in logarithmic form. It can be seen, therefore, that there is a 60% or more improvement in heat flux transferred by the surface at any given temperature difference. In general terms, therefore, the use of a corrugated fin having two layers and formed in accordance with the invention leads to a 60% improvement in the ability of the surface to transfer heat into the fluid.

FIG. 7 illustrates a similar arrangement, except that the corrugated fins were brazed between two plates and the outer plate was covered with a PTFE tape. Again the corrugations were disposed vertically and liquid nitrogen flowed up the region between the corrugations. The line 30 corresponds to the measurements taken whilst the temperature difference was bring increased and the line 31 corresponds to the measurements taken while the heating was being decreased. Lines 30 and 31 relate to single thickness fins in accordance with the prior art. Similar measurements were taken with double thickness fins in accordance with the present invention and lines 32 and 33 were generated in the cases where the temperature was being increased and reduced respectively. It can be seen that the difference 34 between lines 30 and 32 again corresponds to a near 60% improvement in heat exchange characteristics.

It will be realised that by utilising the fins as a primary boiling surface within the liquid to be boiled, increased nucleation of the liquid can occur. It will also be appreciated that the manufacture of the two layer corrugated and apertured fins is a very simple operation and enables the invention to be put into practice without any difficulty. Prior art systems which essentially look to enhance the nucleation on the primary heated surface—rather than a secondary surface as is a fin—require the provision of extra treated surfaces and compounds the difficulty of manufacturing a satisfactory heat exchanger.

It will be appreciated that three or more layers could be used to obtain the improvements of the present invention.

I claim:

1. A plate fin heat exchanger for boiling a liquid, the heat exchanger having a plurality of stacked spaced plates of fluid impervious material adapted and arranged to be heated in use on the first side and to have a liquid to be vaporized on the second side, the second sides of adjacent plates facing each other, there being located between adjacent second sides at least one fin extending, in use, into the liquid to be vaporized, the fin being a separate item formed separately from the plates, wherein the improvement comprises the fin being of at least two layers at least in part having a small gap therebetween, one at least of the outer layers having a plurality of holes therein.

2. A heat exchanger as in claim 1 in which the at least one fin has two layers, and each layer has a plurality of holes therein, some at least of the holes being non-coincident between the two sheets.

3. A heat exchanger as in claim 1 in which the at least one is metal and the layers touch over part of their area.

4. A heat exchanger as in claim 1 in which, in at least part of the heat exchanger, all of the fins in the portion of the heat exchanger adapted to boil liquids are in the improved form.

5. A heat exchanger as in claim 1 in which the at least one fin is formed of aluminium and in which it is brazed to the fluid impervious surface.

6. A heat exchanger as in claim 1 in which the gap between the layers of the at least one fin is in the region 2 to 50 microns.

7. A heat exchanger as in claim 6 wherein said gap is in the region 2 to 10 microns.

8. A heat exchanger as in claim 6 wherein said gap is 5 microns.

9. A heat exchanger as in claim 6 wherein the holes have a diameter in the range 100 to 3,000 microns.

10. A heat exchanger as in claim 6 wherein the holes have a diameter in the range 500 to 2,000 microns.

11. A heat exchanger as in claim 9 wherein the holes are disposed at an overall density of 5 to 10/cm$^2$.

12. A heat exchanger as in claim 11 wherein the holes are disposed at an overall density of 6/cm$^2$.

13. A heat exchanger as in claim 1 wherein the thickness of each layer of the at least one fin is in the range 0.1 to 0.3 mm.

14. A heat exchanger as in claim 13 wherein the thickness of each layer of the at least one fin is in the range 0.1 to 0.2 mm.

15. A heat exchanger as in claim 13 wherein the thickness of each layer of the at least one fin is 0.15 mm.

16. A heat exchanger as in claim 1 in which the at least one fin is formed by superimposing two or more layers of apertured sheets one above the other and corrugating the superimposed sheets.

* * * * *